US009236177B2

(12) United States Patent
Yang et al.

(10) Patent No.: US 9,236,177 B2
(45) Date of Patent: Jan. 12, 2016

(54) COMMON MODE FILTER

(71) Applicant: Samsung Electro-Mechanics Co., Ltd., Suwon (KR)

(72) Inventors: Ju-Hwan Yang, Suwon (KR); Won-Chul Sim, Suwon (KR); Chang-Bae Lee, Suwon (KR); Jin-Ho Hong, Suwon (KR); Keun-Yong Lee, Suwon (KR); Sa-Yong Lee, Suwon (KR); Young-Do Kweon, Suwon (KR)

(73) Assignee: Samsung Electro-Mechanics Co., Ltd., Suwon-Si, Gyeonggi-Do (KR)

( * ) Notice: Subject to any disclaimer, the term of this patent is extended or adjusted under 35 U.S.C. 154(b) by 2 days.

(21) Appl. No.: 14/097,966

(22) Filed: Dec. 5, 2013

(65) Prior Publication Data

US 2015/0102886 A1 Apr. 16, 2015

(30) Foreign Application Priority Data

Oct. 16, 2013 (KR) ..... 10-2013-0123493

(51) Int. Cl.
*H01F 5/00* (2006.01)
*H01F 27/28* (2006.01)
*H01F 17/00* (2006.01)

(52) U.S. Cl.
CPC .... *H01F 17/0013* (2013.01); *H01F 2017/0093* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 6,593,841 | B1 * | 7/2003 | Mizoguchi et al. | 336/200 |
| 2005/0140488 | A1 * | 6/2005 | Shimoyama et al. | 336/200 |
| 2005/0253677 | A1 * | 11/2005 | Ito et al. | 336/200 |
| 2012/0119863 | A1 * | 5/2012 | Wu | 336/192 |

FOREIGN PATENT DOCUMENTS

| | | | |
|---|---|---|---|
| JP | 57050410 | A * | 3/1982 |
| JP | 2008072073 | A * | 3/2008 |
| WO | WO 2012128027 | A1 * | 9/2012 |

* cited by examiner

*Primary Examiner* — Tsz Chan
(74) *Attorney, Agent, or Firm* — McDermott Will & Emery LLP

(57) ABSTRACT

A common mode filter is disclosed. The common mode filter in accordance with an embodiment of the present invention includes: a magnetic substrate; a coil pattern formed on the magnetic substrate; a dielectric layer formed on the magnetic substrate so as to cover an upper part, a lower part and a side surface of the coil pattern; and a first coupling agent interposed between the magnetic substrate and the dielectric layer so as to prevent the magnetic substrate and the dielectric layer from being separated.

5 Claims, 1 Drawing Sheet

COMMON MODE FILTER

CROSS-REFERENCE TO RELATED APPLICATIONS

This application claims the benefit of Korean Patent Application No. 10-2013-0123493, filed with the Korean Intellectual Property Office on Oct. 16, 2013, the disclosure of which is incorporated herein by reference in its entirety.

BACKGROUND

1. Technical Field

The present invention relates to a common mode filter.

2. Background Art

High-speed digital interfaces, such as USB, require a part that address noise. One of such parts that removes common mode noise selectively is a common mode filter.

Common mode noise can occur when impedance fails to be parallel in the wiring system. The common mode noise can occur more often for higher frequency. Since the common mode noise can be also transferred to, for example, the surface of the earth and bounced back with a big loop, the common mode noise causes various kinds of noise troubles in far-away electronic devices.

The common mode filter can allow a differential mode signal to bypass while selectively removing the common mode noise. In the common mode filter, magnetic flux is canceled out by the differential mode signal, causing no inductance to occur and allowing the differential mode signal to bypass. On the other hand, magnetic flux is augmented by the common mode noise, increasing the inductance and allowing the noise to be removed.

The related art of the present invention is disclosed in Korea Patent Publication No. 2011-0129844 (COMMON MODE NOISE FILTER; laid open on Dec. 6, 2011).

SUMMARY

The present invention provides a common mode filter having a coupling agent interposed in between a magnetic substrate and a dielectric layer.

The common mode filter in accordance with an embodiment of the present invention can include: a magnetic substrate; a coil pattern formed on the magnetic substrate; a dielectric layer formed on the magnetic substrate so as to cover an upper part, a lower part and a side surface of the coil pattern; and a first coupling agent interposed between the magnetic substrate and the dielectric layer so as to prevent the magnetic substrate and the dielectric layer from being separated.

The common mode filter can also include a magnetic layer formed on the dielectric layer.

The common mode filter can also include an external electrode connected to an end part of the coil pattern and formed on the magnetic substrate in such a way that one surface thereof is exposed to an outside.

The first coupling agent can be made of a material including silane.

The magnetic substrate can include ferrite, and the dielectric layer can include epoxy.

The common mode filter can also include a second coupling agent interposed between the coil pattern and the dielectric layer so as to prevent the coil pattern and the dielectric layer from being separated.

DETAILED DESCRIPTION

Figure 1:
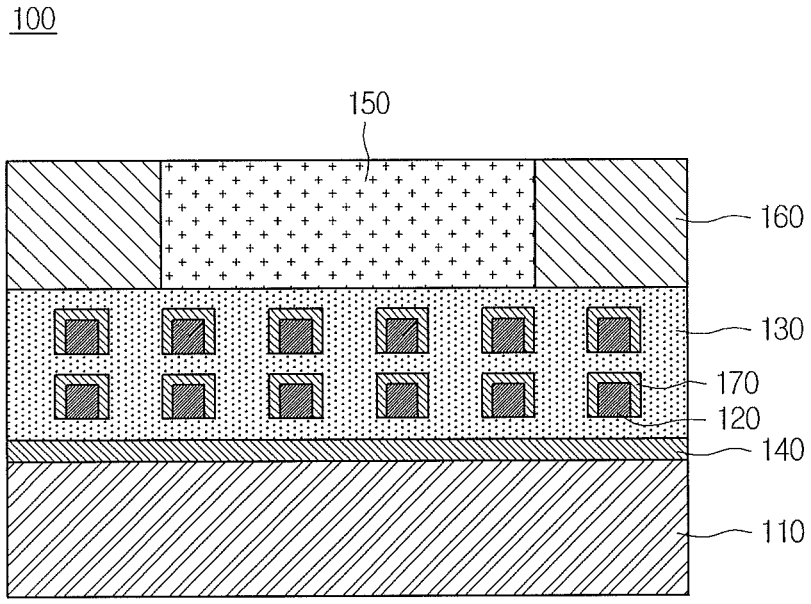
FIG. 1 is a cross-sectional view showing a common mode filter in accordance with an embodiment of the present invention.

Hereinafter, a certain embodiment of a common mode filter in accordance with the present invention will be described in detail with reference to the accompanying drawings. In describing the present invention with reference to the accompanying drawings, any identical or corresponding elements will be assigned with same reference numerals, and no redundant description thereof will be provided.

Terms such as "first" and "second" can be used in merely distinguishing one element from other identical or corresponding elements, but the above elements shall not be restricted to the above terms.

When one element is described to be "coupled" to another element, it does not refer to a physical, direct contact between these elements only, but it shall also include the possibility of yet another element being interposed between these elements and each of these elements being in contact with said yet another element.

Figure 2:
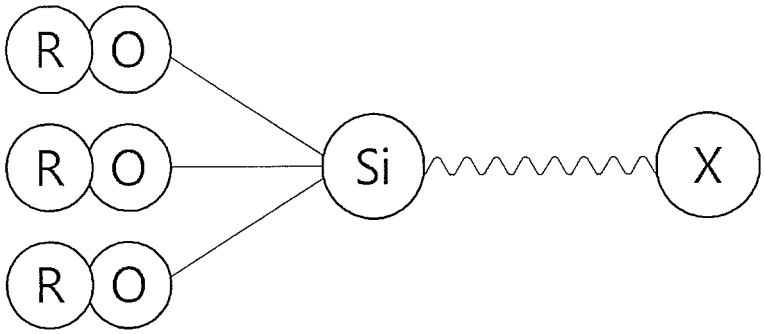
FIG. 2 shows the structure of a silane coupling agent used in the common mode filter in accordance with an embodiment of the present invention.

FIG. 1 is a cross-sectional view showing a common mode filter in accordance with an embodiment of the present invention. FIG. 2 shows the structure of a silane coupling agent used in the common mode filter in accordance with an embodiment of the present invention.

Referring to FIG. 1, the common mode filter 100 in accordance with an embodiment of the present invention can include magnetic substrate 110, coil pattern 120, dielectric layer 130, first coupling agent 140, magnetic layer 150, external electrode 160 and second coupling agent 170.

The magnetic substrate 110 is a board that is magnetic and is placed at a lowermost location of the common mode filter. The magnetic substrate 110 can include at least one of metal, polymer and ceramic, which are magnetic materials.

The coil pattern 120 is a device that functions as an inductor. The coil pattern 120 can be spirally formed to be adjacent to one another but not to overlap with one another. The spirally-formed coil pattern 120 can increase the length of the pattern, thereby increasing the inductance.

The spiral-type coil pattern 120 can be formed in a dual-layer structure. The first layer of coil pattern 120 has the shape of winding from an outside to an inside, and the second layer of coil pattern 120 has the shape of winding from an inside to an outside. The first layer of coil pattern 120 and the second layer of coil pattern 120 can be connected to each other at a center.

The coil pattern 120 can be constituted with a pair of coils. Magnetic coherence occurs in between the pair of coils of the coil pattern 120. In the case of common mode noise, the inductance becomes augmented as the magnetic flux occurred by the common mode noise is combined. As a result, the noise can be removed.

The coil pattern 120 can be made of copper (Cu) or aluminum (Al), which is highly conductive and workable. Moreover, the coil pattern can be formed through photolithography and plating.

The dielectric layer 130 is a layer that surrounds the coil pattern 120 and can insulate the magnetic substrate 110 and the coil pattern 120. The dielectric layer 130 can be formed on the magnetic substrate 110. Preferably used as a material for the dielectric layer 130 can be polymer resin, which has a good electrical insulation property and is highly workable, for example, epoxy resin or polyimide resin.

The dielectric layer 130 can be partially formed before the coil pattern 120 is formed, and then another portion of the dielectric layer 130 can be successively formed after the coil pattern 120 is formed so as to cover the coil pattern 120. Accordingly, the dielectric layer 130 can cover all of an upper part, a lower part and side surfaces of the coil pattern 120.

The first coupling agent 140 can be interposed between the magnetic substrate 110 and the dielectric layer 130 so as to prevent the magnetic substrate 110 and the dielectric layer 130 from being separated from each other. By interposing the first coupling agent 140 between the magnetic substrate 110 and the dielectric layer 130, a stronger chemical bond can be made between the magnetic substrate 110 and the dielectric layer 130. Accordingly, owing to the first coupling agent 140, it becomes possible to prevent delamination between the magnetic substrate 110 and the dielectric layer 130.

The first coupling agent 140 can include silane coupling agent. The structure of the silane coupling agent is illustrated in FIG. 2. The silane coupling agent can have two or more functional groups.

In FIG. 2, the first functional group (OR) is bonded with metallic inorganic material included in the magnetic substrate 110. In such a case, the first functional group is hydrolyzed and chemically bonded (e.g., ionic bond) with a surface of the magnetic substrate 110. The alkoxysilyl group (Si—OR) is hydrolyzed to become a silanol group (Si—OH), which condensation-reacts with the surface of the magnetic substrate 110. The second functional group (X) is where the dielectric layer 130 is bonded (e.g., covalent bond).

To realize the bonding by the silane coupling agent, the silane coupling agent can be interposed between the magnetic substrate 110 and the dielectric layer 130 and then heated to 200° C.

In the case where the magnetic substrate 110 includes ferrite and the dielectric layer 130 includes epoxy, an excellent adhesion between the magnetic substrate 110 and the dielectric layer 130 can be achieved by interposing the silane coupling agent in between the magnetic substrate 110, which includes ferrite, and the dielectric layer 130, which includes epoxy.

Referring to FIG. 1 again, the magnetic layer 150 is a layer that is formed on the dielectric layer 130 and is magnetic. The magnetic layer 150 forms a closed-magnetic circuit together with the magnetic substrate 110. Magnetic coupling of the coil pattern 120 can be enhanced by the strong magnetic flux formed by the magnetic layer 150 and the magnetic substrate 110.

The magnetic layer 150 can include magnetic powder and resin material. The magnetic powder allows the magnetic layer 150 to be magnetic, and the resin material allows the magnetic layer 150 to have fluidity. In such a case, the magnetic powder can include ferrite.

The external electrode 160 is connected with an end of the coil pattern 120 and is formed on the magnetic substrate 110 so as to have one surface thereof to be exposed to an outside. The external electrode 160 can be formed on the dielectric layer 130. The external electrode 160 is configured for inputting and outputting a signal. The magnetic layer 150 can be formed by avoiding the external electrode 160 so as to allow one surface of the external electrode 160 to be exposed.

The common mode filter 100 in accordance with an embodiment of the present invention can further include the second coupling agent 170, which is interposed in between the coil pattern 120 and the dielectric layer 130 so as to prevent the coil pattern 120 and the dielectric layer 130 from being separated from each other. That is, the second coupling agent 170 can be formed on a surface of the coil pattern 120. In such a case, the second coupling agent 170 can be made of components including silane.

By introducing the second coupling agent 170, coupling between the coil pattern 120 and the dielectric layer 130 can become stronger, thereby making the dielectric layer 130 insulate the coil pattern 120 much better.

In the case where the coil pattern 120 is formed in a dual-layer structure, the second coupling agent 170 can be coupled to each layer of the coil pattern 120.

As described above, in accordance with an embodiment of the present invention, coupling between the magnetic substrate 110 and the dielectric layer 130 or between the coil pattern 120 and the dielectric layer 130 can be improved. Particularly, as the coupling is improved between the magnetic substrate 110 and the dielectric layer 130, the delamination and crack of the magnetic substrate 110 and the dielectric layer 130 can be reduced. Delamination and crack can allow moisture to be absorbed into the common mode filter 100 and adversely affect the reliability of the common mode filter 100. Therefore, moisture resistance can be enhanced and the reliability of the common mode filter can be improved by the above-described coupling agent.

Although a certain embodiment of the present invention has been described, it shall be appreciated that there can be a very large number of permutations and modification of the present invention by those who are ordinarily skilled in the art to which the present invention pertains without departing from the technical ideas and boundaries of the present invention, which shall be defined by the claims appended below.

It shall be also appreciated that many other embodiments other than the embodiment described above are included in the claims of the present invention.

What is claimed is:

1. A common mode filter comprising:

a magnetic substrate;

a coil pattern formed on the magnetic substrate;

a dielectric layer formed on the magnetic substrate so as to cover an upper part, a lower part and a side surface of the coil pattern;

a first coupling agent interposed between the magnetic substrate and the dielectric layer so as to prevent the magnetic substrate and the dielectric layer from being separated; and a second coupling agent covering at least one surface of an upper surface and a side surface of the coil pattern so as to prevent the coil pattern and the dielectric layer from being separated, wherein the first coupling agent and the second coupling agent are made of a material including silane having at least two functional groups.

2. The common mode filter of claim 1, further comprising a magnetic layer formed on the dielectric layer.

3. The common mode filter of claim 1, further comprising an external electrode connected to an end part of the coil pattern and formed on the magnetic substrate in such a way that one surface thereof is exposed to an outside.

4. The common mode filter of claim 1, wherein the magnetic substrate comprises ferrite and the dielectric layer comprises epoxy.

5. The common mode filter of claim 1, wherein the magnetic substrate comprises at least one of metal, polymer and ceramic.

* * * * *